United States Patent [19]

Bland et al.

[11] 4,432,734

[45] Feb. 21, 1984

[54] MARINE PROPULSION DEVICE INCLUDING IGNITION INTERRUPTION MEANS TO ASSIST TRANSMISSION SHIFTING

[75] Inventors: Gerald F. Bland, Kenosha, Wis.; Donald K. Sullivan, Waukegan, Ill.

[73] Assignee: Outboard Marine Corporation, Waukegan, Ill.

[21] Appl. No.: 338,304

[22] Filed: Jan. 11, 1982

[51] Int. Cl.[3] ..... B63H 23/04; B63H 23/06

[52] U.S. Cl. ..... 440/1; 74/851; 192/0.062; 192/0.084; 440/84; 440/86

[58] Field of Search ..... 440/75, 84, 86, 1; 74/851, 852, 861, 843; 123/198 DC, 335, 630; 192/0.062, 0.084

[56] References Cited

U.S. PATENT DOCUMENTS

| | | | |
|---|---|---|---|
| 2,519,080 | 8/1950 | Simpson | 192/0.084 |
| 2,743,624 | 5/1956 | Schroeder | 74/843 |
| 4,262,622 | 4/1981 | Dretzka et al. | 440/86 |

*Primary Examiner*—Sherman Basinger

*Attorney, Agent, or Firm*—Michael, Best & Friedrich

[57] ABSTRACT

Shifting of a marine propulsion device transmission drivingly connecting a drive shaft to an internal combustion engine and including a rotatable member operable to shift the transmission between forward drive, reverse drive and neutral positions in response to rotation of a shift lever is assisted by an arrangement including a pin or element pivotally connected to a push-pull assembly operated by a main control and carried by the shift lever. The shift assistance arrangement includes a spring which retains the element in a normal position relative to the shift lever when shift resistance to movement of the transmission from an "in gear" to the neutral position is less than a predetermined level and permits displacement of the element relative to the shift lever from the normal position when the shift resistance is above that predetermined level. The shift assistance arrangement also includes a switch operable when actuated to selectively interrupt engine ignition. This switch is carried on the shift lever and is actuated to interrupt engine ignition in response to displacement of the element from the normal position.

7 Claims, 7 Drawing Figures

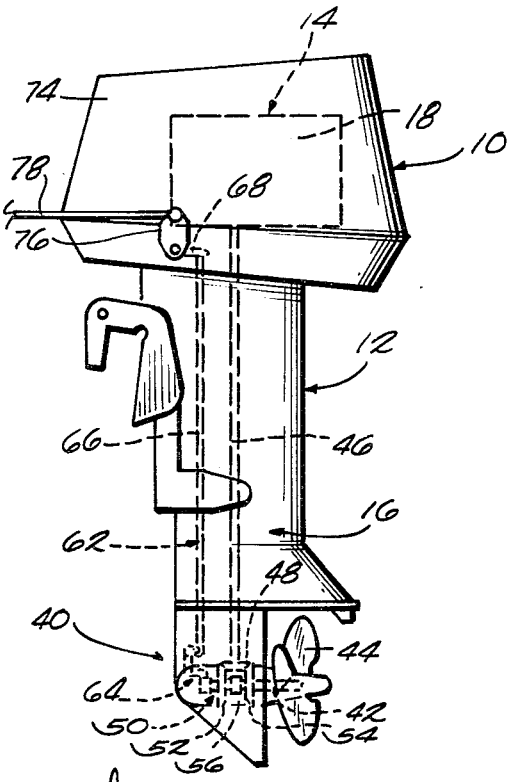
Fig. 1
Fig. 2
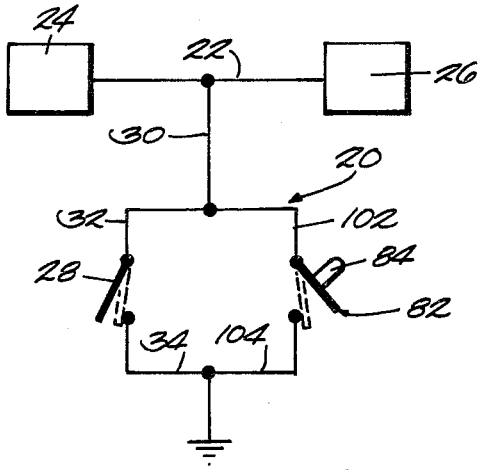
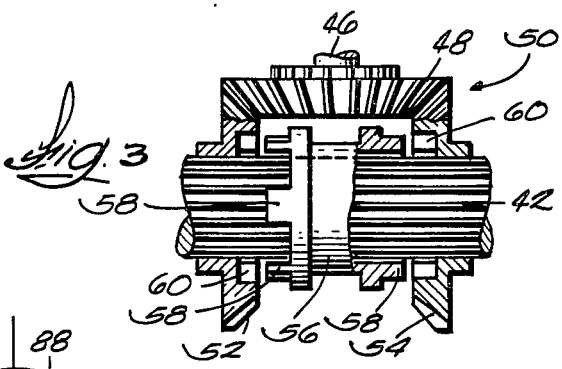
Fig. 3
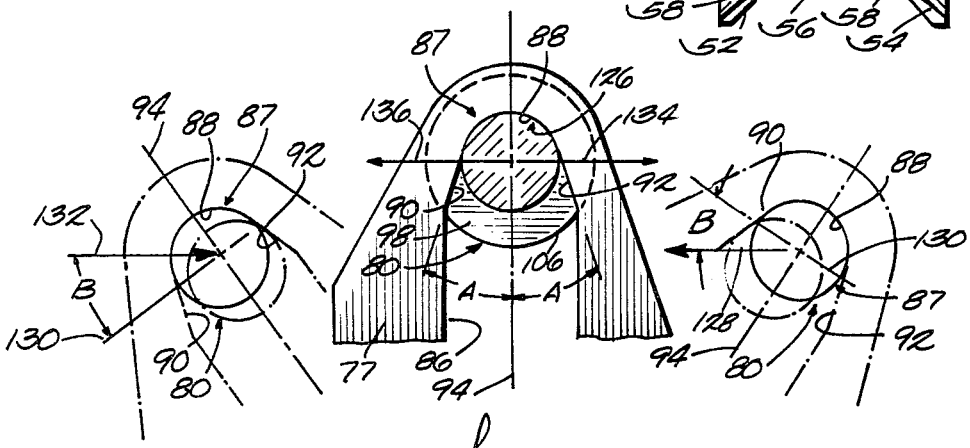
Fig. 7

MARINE PROPULSION DEVICE INCLUDING IGNITION INTERRUPTION MEANS TO ASSIST TRANSMISSION SHIFTING

BACKGROUND OF THE INVENTION

This invention relates to marine propulsion devices, such as stern drive units and outboard motors, including a reversing transmission and a shifting mechanism therefor and, more particularly, to marine propulsion devices including means to assist transmission shifting.

Marine propulsion devices such as outboard motors and stern drive units commonly employ reversing clutches or transmissions which connect the output shaft of an engine to the propeller shaft to provide forward drive, reverse drive and neutral operations. Such transmissions frequently include a pair of opposed, axially spaced drive gears and a clutch dog which is splined to the propeller shaft and can be selectively shifted axially into engagement with the drive gears. The shiftable clutch dog has driving lugs which engage complementary driving lugs on the drive gears.

Relatively high shift load can be experienced when attempting to shift the transmission from either forward drive or reverse drive to neutral. The torque exerted on the clutch dog lugs by a drive gear creates a resistance to movement of the clutch dog from an "in gear" position to neutral. Shifting can be facilitated by momentarily interrupting engine operation and thereby minimizing this torque.

Examples of prior arrangements including an electrical control for facilitating transmission shifting are disclosed in the following United States patents:

| Patentee | U.S. PAT. NO. | Issue Date |
|---|---|---|
| Elkin | 2,297,676 | Oct. 6, 1942 |
| Moori et al | 3,910,388 | Oct. 7, 1975 |
| Leighton et al | 4,072,204 | Feb. 7, 1978 |
| Long | 4,215,596 | Aug. 5, 1980 |
| Dretzka et al | 4,262,622 | April 21, 1981 |

SUMMARY OF THE INVENTION

The invention provides apparatus for assisting shifting of a transmission in a marine propulsion device including an internal combustion engine driving a drive shaft, a reversible transmission drivingly connecting the drive shaft with a propeller shaft and movable between forward drive, reverse drive and neutral positions, and a shift assembly including a rotatable member for shifting the transmission between the forward drive, reverse drive and neutral positions in response to rotation of the rotatable member by a shift lever, which apparatus includes an element for movement by an operator to effect shifting and carried by the shift lever for common movement therewith and for movement relative to the shift lever when shift resistance to movement of the transmission from either the forward drive position or the reverse drive position to the neutral position is greater than a predetermined level, and means for interrupting engine ignition in response to movement of the element relative to the shift lever.

The invention also providing a marine propulsion device including an internal combustion engine, a propulsion unit, a propeller shaft rotatably mounted in the propulsion unit and carrying a propeller, a drive shaft driven by the internal combustion engine and including a drive gear, a transmission including first and second bevel gears rotatably mounted on the propeller shaft and in meshing engagement with the drive gear and also including clutch dog means mounted on the propeller shaft for common rotation therewith and for reciprocal axial movement between the neutral position wherein the clutch dog means is out of engagement with both of the bevel gears, the forward drive position wherein the clutch dog means is in meshing engagement with the first bevel gear, and the reverse drive position wherein the clutch dog means is in meshing engagement with the second bevel gear, shift means including a rotatable member operably connected to the clutch dog means for moving the clutch dog means axially between the forward drive, the reverse drive and neutral positions in response to rotation to the rotatable member by a shift lever, and shift assistance means including an element adapted for movement by an operator to effect shifting and carried by the shift lever for common movement therewith and for movement relative to the shift lever when the shift resistance is greater than the predetermined level and means for interrupting engine ignition in response to movement of the element relative to the shift lever.

In one embodiment, the shift assistance means includes biasing means for retaining the element in a normal position relative to the shift lever when the shift lever is moved in response to a force applied on the element by an operator control and the shift resistance is below the predetermined level, and for permitting displacement of the element relative to the shift lever from the normal position when the shift resistance exceeds the predetermined level. In addition, the ignition interruption means is operable to selectively interrupt engine ignition in response to the displacement of the element from the normal position.

In one embodiment, the interruption means includes a switch carried by the shift lever and operable when actuated to selectively interrupt engine ignition and the element is moved from the normal position to overcome the biasing force of the biasing means and actuate the switch when an operator applies a force on the element to shift the transmission and the shift resistance exceeds the predetermined level.

In one embodiment, the operator control includes a push-pull assembly pivotally connected to the element and the shift lever has a cam surface which is engaged by and guides movement of the element relative to the shift lever. The cam surface has a central portion and diverging ramp portions extending from the central portion toward the switch. The element is disposed in the central portion of the cam surface when in the normal position and moves along one of the ramp portions when a pulling or pushing force is applied on the element by the push-pull assembly to move the transmission from one position to another and the shift resistance exceeds the predetermined level.

One of the principal features of the invention is the provision of a marine propulsion device including a reversing transmission and means for momentarily interrupting engine ignition in the event the resistance to shifting the transmission from forward drive or reverse drive to neutral exceeds a predetermined level.

Another of the principal features of the invention is the provision of such a marine propulsion device wherein the ignition interrupting means is operable in response to movement of a shift lever which is connected to an operator control and rotates a rotatable member operable to shift the transmission in response to rotation of the rotatable member.

A further of the principal features of the invention is the provision of such a marine propulsion device wherein the ignition interruption means can be conveniently installed as a kit on an existing construction.

Other features, aspects and advantages of the invention will become apparent to those skilled in the art upon reviewing the following detailed description, the drawings and the appended claims.

BRIEF DESCRIPTION OF THE DRAWINGS

FIG. 1 is a side elevational view of an outboard motor embodying various of the features of the invention.

FIG. 2 is a diagrammatic representation of the ignition interruption circuit included in the outboard motor shown in FIG. 1.

FIG. 3 is an enlarged, partially sectioned view of the transmission included in the outboard motor shown in FIG. 1.

FIG. 7 are fragmentary, broken away, side elevational views of the upper end of the shift lever shown in FIG. 4, taken generally along line 7—7 in FIG. 4 and illustrating the location of the shift lever and an actuating element when the shift lever is in the neutral, forward drive and reverse drive positions.

Figure 4:
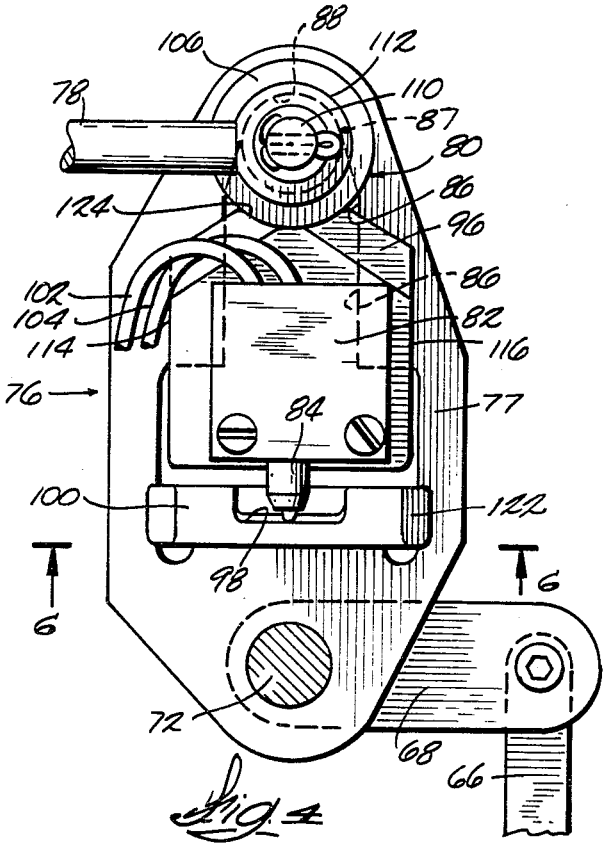
FIG. 4 is an enlarged, fragmentary, elevational view of the shift lever and associated components for shifting the transmission of the outboard motor shown in FIG. 1.

Before explaining at least one of the embodiments of the invention in detail, it is to be understood that the invention is not limited in its application to the details of construction and the arrangements of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

The invention will be described for use in an outboard motor. However, it can be adapted for use in a stern drive unit and other marine propulsion devices.

Illustrated in FIG. 1 is an outboard motor 10 having a propulsion unit 12 including a power head 14 and a lower unit 16. The power head 14 includes a conventional internal combustion engine 18 having a suitable ignition system 20 shown diagrammtically in FIG. 2.

The engine ignition circuit 20 includes an electrical lead 22 connecting an electrical power supply 24, such as a flywheel magneto, to the engine spark plug(s) 26, and an on-off ignition switch 28 connected between the supply lead 22 and the engine ground via electrical leads 30, 32 and 34. The ignition switch 28 is movable between an "on" or engine operating position (illustrated by the solid line in FIG. 2) to permit flow of electrical current to the spark plug(s) 26 and an "off" or engine shutdown position (illustrated by the dashed line in FIG. 2) to ground or short out the power supply 24 via leads 30, 32 and 34, thereby interrupting current flow to the spark plug(s) 26.

The lower unit 16 includes a gearcase 40 which is normally under water. Rotatably mounted in the gearcase 40 is a propeller shaft 42 carrying a propeller 44. Extending through the lower unit 16 transversely of the propeller shaft 42 is a rotatably mounted drive shaft 46 which is operably connected at the upper end to the engine 18 and carries a bevel drive gear 48 on the lower end.

The drive shaft 46 is drivingly connected to the propeller shaft 42 through a conventional reversing clutch or transmission 50. The transmission 50 includes a pair of axially spaced bevel gears 52 and 54 which are mounted for rotation coaxially with and independently of the propeller shaft 42 and mesh with the drive gear 48. The transmission 50 also includes a shiftable clutch dog 56 which is carried on the propeller shaft 42 between the bevel gears 52 and 54 and includes (FIG. 3) one or more drive lugs 58 on the opposite end faces.

As best shown in FIG. 3, the clutch dog 56 is splined on the propeller shaft 42 for common rotation therewith and for relative axial movement between a central or neutral position out of engagement with the bevel gears 52 and 54, a forward drive position (to the left to the neutral position shown in FIG. 3) wherein the drive lugs 58 on the left end face of the clutch dog 56 are engaged with complementary drive lugs 60 on the bevel gear 52, and a reverse drive position (to theright of the neutral position shown in FIG. 3) wherein the drive lugs 58 on the right end face of the clutch dog 56 engage complementary drive lugs 60 on the bevel gear 54. Thus, when the clutch dog drive lugs 58 are selectively fully engaged with the complementary drive lugs 60 on the bevel gears 52 and 54, the propeller shaft 42 is driven in the forward drive condition and the reverse drive condition, respectively. When the clutch dog 56 is in the neutral position disengaged from both the bevel gears 52 and 54, the propeller shaft 42 is not rotated because the bevel gears rotate independently of the propeller shaft 42.

The clutch dog 56 is moved axially between the neutral, forward drive and reverse drive positions by a conventional lower shift mechanism, generally designated by reference numeral 62, including a shift actuator 64 operatively connected to the clutch dog 56 for common axial movement therewith while affording rotation of the propeller shaft 42 relative to the clutch dog 56 and to the shift actuator 64. The shift mechanism 62 also includes a control or actuating rod 66 supported in the propulsion unit 12 for reciprocal movement transversely of the propeller shaft 42. The lower end of the acutating rod 66 is operably connected to the shift actuator 64 to effect axial movement of the shift actuator 64 and the clutch dog 56 relative to the propeller shaft 42 in response to movement of the actuating rod 66 transversely of the propeller shaft 42.

Figure 5:
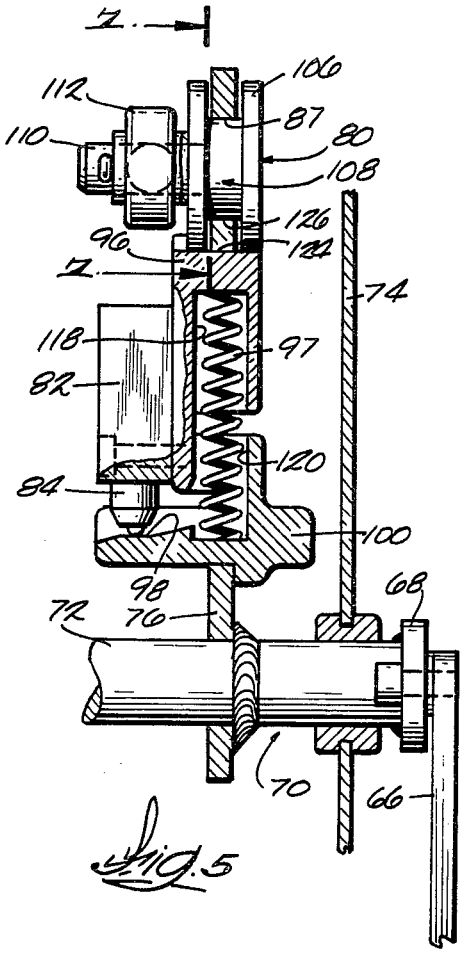
FIG. 5 is a partially sectioned, end view of the shift lever and associated components shown in FIG. 4.

The upper end of the actuating rod 66 is pivotally connected to an arm 68 mounted on a rotatably supported shift control shaft 70 (FIGS. 4 and 5) having an outer end portion 72. The outer end portion 72 of the shift control shaft 70 and the arm 68 can be located exteriorly of the power head cover 74 as illustrated. However, for applications where the power head 14 is located relative close to the water during operation, these components more desirably are located inside the power head cover 74. Rotation or rocking movement of the shift control shaft 70 effects reciprocal movement of the actuating rod 66 to shift the transmission 62 between forward drive, reverse drive and neutral positions.

The shift control shaft 70 is rotated to selectively shift the transmission 50 via a shift lever assembly 76 including a shift lever 77 fixedly mounted on the outer end portion 72 of the shift control shaft. The shift lever assembly 76 is connected to a main control lever (not shown) via a push-pull control cable assembly 78 and rotates in opposite directions from a neutral position in response to back and forth movement of the push-pull cable assembly 78 resulting from operation of the main control lever by the operator.

Relatively high shift loads can be experienced when attempting to shift the transmission 50 from either the forward drive or the reverse drive position to the neutral position at speeds higher than idle speed. Such loads are the result of torque exerted on the clutch dog drive lugs 58 by the drive lugs 60 on the bevel gears 52 and 54, creating a resistance to axial movement of the clutch dog 56 from an "in gear" position to the neutral position. In order to shift out of gear, means are provided for momentarily interrupting engine ignition in response to movement of the shift lever 77 by an operator from either the forward drive position or the reverse drive position to the neutral position when the shift resistance exceeds a predetermined level, thereby reducing the above-described torque and facilitating easier axial movement of the clutch dog from an "in gear" position to the neutral position.

More particularly, the shift lever assembly 76 includes an element or pin 80 which is pivotally connected to one end of the push-pull cable assembly 78 and by which movement of the shift lever 77 is effected. The pin 80 is carried by the shift lever 77 for common movement therewith and for movement relative thereto from a normal position when a force greater than the predetermined level must be applied on the shift lever 77 to move the shift lever from either the forward drive position or the reverse drive position to the neutral position in response to movement of the push-pull cable assembly 78 by the operator. The shift lever assembly 76 includes a normally open switch 82 mounted on the shift lever 77 and having a plunger or actuator 84 which is actuated to close the switch 82 when the pin 80 is displaced from the normal position.

Specifically, the pin 80 is disposed in the upper portion of an opening or slot 86 in the shift lever 77. The upper portion of the slot 86 is in the form of a cam surface 87 having a rounded central portion 88 and a pair of diverging ramps 90 and 92 extending from the central portion 88 toward to the switch 82 at an acute angle "A" to the longitudinal axis 94 of the shift lever 77. The pin 80 is urged toward a normal position in the central portion 88 of the cam surface 87 by a slider element 96 slidably mounted in the slot 86 and biased against the pin 80 by a coiled, compression spring 97. The switch 82 is mounted on the slider element 96 and the outer end of the switch actuator 84 rests on a generally flat surface 98 on a retainer 100 disposed in the lower portion of the slot 86.

The switch 82 (FIG. 2) is connected in the engine ignition circuit 20 via electrical leads 102 and 104. When the switch actuator 84 is deactuated, the switch 82 is open as illustrated by the solid line and engine ignition operates in a normal manner. When the switch actuator 84 is depressed (actuated), the switch 82 closes as illustrated by the dashed line and the power supply 24 is shorted out to ground via leads 30, 102, and 104, thereby interrupting current flow to the engine spark plug(s) 26.

The pin 80 has an enlarged portion or head 106 including an annular recess 108 which receives a part of the shift lever 77 surrounding the upper portion of the slot 86 and operates therewith to guide movement of the pin 80 relative to the shift lever 77 as described below. The pin 80 also has a smaller shaft portion 110 on which an end fitting 112 of the push-pull cable assembly 78 is pivotally mounted.

Figure 6:
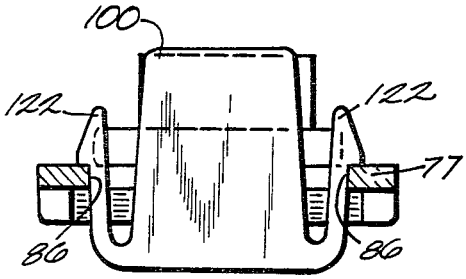
FIG. 6 is a bottom plan view of the shift lever shown in FIG. 4.

The opposite edges of 114 and 116 of the slider element 96 are provided with longitudinally extending grooves (not shown) which slidably receive portions of the shift lever 77 adjacent the sides of the slot 86 and cooperate therewith to guide reciprocal movement of the slider element 96 as described below. The slider element 96 (FIG. 5) has a pocket 118 which receives one end of the spring 97. The retainer 100, preferably made from a resilient, synthetic plastic material, has a pocket 120 for receiving the other end of the spring 97. The retainer 100 (FIG. 6) also has a pair of laterally-spaced, snap-in legs or fingers 122.

During assembly, the pin 80 is first positioned in the central portion 88 of the cam surface 87. The slider element 96 with the switch 82 attached is then placed in the slot 86 and an arcuate surface 124 on the slider element 96 is moved into engagement with the head 106 of the pin 80. One end of the spring 97 is inserted into the slider element pocket 118 and the retainer 100 is snapped into position with other end of the spring 97 seated in the retainer pocket 120.

Referring to FIG. 7, when the shift lever 77 is in the neutral position illustrated by solid lines, the spring 97, acting through the slider element 96, forces the bottom surface 126 of the pin recess 108 into engagement with the central portion 88 of the cam surface 87. When the shift lever 77 is in the forward drive position (the right hand position illustrated by dashed lines in FIG. 7) and the operator operates the main control to shift the transmission to the neutral position, a pulling force generally in the direction of arrow 128 and at an angle "B" to a plane (designated by reference numeral 130) extending perpendicularly to the shift lever axis 94 is applied on the pin 80 by the push-pull cable assembly 78. As the shift lever 77 is rotated toward the neutral position, a downward force component tends to move the pin 80 along the ramp 90 against the biasing force of the spring 97. If the shift resistance (i.e., force required to move the clutch-dog 56 "out of gear") is in excess of a predetermined level, this downward force component is sufficient to overcome the biasing force of the spring 97, the pin 80 moves the slider element 96 downwardly as illustrated by dashed lines to depress the switch actuator 84 and the switch 82 closes to interrupt engine ignition as described above. Once the clutch-dog 56 is disengaged from the bevel gear 54, the spring 97 returns the slider element 96 and the pin 80 to the normal position, the switch actuator 84 deactuates, and the switch 82 returns to its normally open position to terminate the interruption of engine ignition.

Engine ignition interruption occurs in the same manner during shifting of the transmission from the reverse drive position (the left hand position illustrated in FIG. 7) to the neutral position, except that a pushing force generally in the direction of arrow 132 and at angle "B" to the plane 130 is applied on the pin 80 and the pin 80 moves along the ramp 92 when the shift resistance is in excess of the predetermined level.

When the shift lever 77 is moved from the neutral position to the forward drive or to the reverse drive position, the primary force applied on the pin 80 is in the direction of arrows 134 and 136, respectfully, at an angle approaching 90° to the shift lever axis 94 or 0° to the plane 130. Accordingly, the downward force component on the slider element 96 is relatively small and substantially higher shift resistance is required during shifting from the neutral position to an "in gear" position before the switch actuator 84 is actuated. This is desirable because the primary purpose of the shift assistance provided by the invention is to interrupt engine ignition during shifting from the forward drive position or the reverse drive position to the neutral position.

The force level at which engine ignition interruption occurs can be varied by varying the spring force of the spring 97, the angle "A" of ramps 90 and 92, and the angle "B" at which the primary force is applied on the pin 80 by the push-pull cable assembly 78.

In order to insure that the duration of engine ignition interruption is not longer than a predetermined time, the switch 82 can be interconnected with a control circuit which is energized in response to actuation of the switch 82 and includes timing means for interrupting engine ignition for a predetermined time interval. For example, an interruption circuit similar to that disclosed in the above-identified Dretzka et al. U.S. Pat. No. 4,262,622 can be used for this purpose, which patent is incorporated herein by reference.

The ignition interrupting means of the invention can be provided as a kit for existing marine propulsion devices including a shift lever connected to a main control lever by a push-pull cable assembly. In that case, the existing shift lever can be replaced by the shift lever assembly 76, the existing push-pull cable assembly connected to the pin 80 and the electrical leads 102 and 104 of the switch 82 wired into the existing engine ignition system.

We claim:

1. A marine propulsion device including an internal combustion engine, a propulsion unit, a propeller shaft rotatably mounted in said propulsion unit and carrying a propeller, a drive shaft rotatably mounted in said propulsion unit and driven by said internal combustion engine, a transmission drivingly connecting said drive shaft with said propeller shaft and movable between forward drive, reverse drive and neutral positions, shift means including a rotatable member operably connected to said transmission for moving said transmission between the forward drive, reverse drive and neutral positions in response to rotation of said member, said shift means further including a shift lever mounted on said rotatable member for rotation in common therewith, and shift assistance means including an element adapted for movement by an operator to effect shifting and carried by said shift lever for common movement therewith and for translatory movement relative to said shift lever when shift resistance to movement of said transmission from either the forward drive position or the reverse drive position to the neutral position is greater than a predetermined level and means for interrupting engine ignition in response to movement of said element relative to said shift lever.

2. A marine propulsion device according to claim 1 wherein said shift assistance means includes biasing means for retaining said element in a normal position relative to said shift lever when said shift lever moves in response to a force applied on said element by an operator control and the shift resistance is below said predetermined level and for permitting displacement of said element relative to said shift lever from the normal position when the shift resistance exceeds said predetermined level, and wherein said ignition interruption means is operable to selectively interrupt engine ignition in response to displacement of said element relative to said shift lever from the normal position.

3. A marine propulsion device according to claim 2 wherein said drive shaft includes a drive gear, wherein said transmission includes first and second bevel gears rotatably mounted on said propeller shaft and in meshing engagement with said drive gear and clutch dog means mounted on said propeller shaft for common rotation therewith and for reciprocal axial movement between the neutral position wherein said clutch dog means is out of engagement with both of the said bevel gears, the forward drive position wherein said clutch dog means is in meshing engagement with said first bevel gear, and the reverse drive position wherein said clutch dog means is in meshing engagement with said second bevel gear, wherein said rotatable member is operable to axially move said clutch means between the forward drive, reverse drive, and neutral positions in response to rotation of said member, and wherein said element is displaced relative to said shift lever when a force is applied on said element by an operator control to shift said transmission from the forward drive or the reverse drive position to the neutral position and a force in excess of said predetermined level is required to disengage said clutch dog means from the respective one of said bevel gears.

4. A marine propulsion device according to claim 2 wherein said interruption means includes a switch carried by said shift lever and operable when actuated to selectively interrupt the ignition of said engine, and wherein said element is mounted on said shift lever for movement relative to said shift lever from the normal position to overcome the biasing force of said biasing means and actuate said switch when a force is applied on said element by the operator control and the shift resistance exceeds said predetermined level.

5. A marine propulsion device according to claim 4 wherein said switch is slidably mounted on said shift lever for movement relative thereto between a normally deactuated position and an actuated position, and wherein said element is mounted to operably engage said switch and move said switch to the actuated position when a force applied on said element by the operator control and the shift resistance exceeds said predetermined level.

6. A marine propulsion device including an internal combustion engine, a propulsion unit, a propeller shaft rotatably mounted in said propulsion unit and carrying a propeller, a drive shaft rotatably mounted in said propulsion unit, driven by said internal combustion engine, and including a drive gear, a transmission drivingly connecting said drive shaft with said propeller shaft and movable between forward drive, reverse drive and neutral positions, said transmission including first and second bevel gears rotatably mounted on said propeller shaft and in meshing engagement with said drive gear, and clutch dog means mounted on said propeller shaft for common rotation therewith and for reciprocal axial movement between the neutral position wherein said clutch dog means is out of engagement with both of the said bevel gears, the forward drive position wherein said clutch dog means is in meshing engagement with said first bevel gear, and the reverse drive position wherein said clutch dog means is in meshing engagement with said second bevel gear, shift means including a rotatable member operably connected to said transmission for axially moving said clutch dog means between the forward drive, reverse drive and neutral positions in response to rotation of said member, a shift lever mounted on said rotatable member, shift assistance means operable to selectively interrupt engine ignition and including an element adapted for movement relative to a normal position to effect shifting and carried by said shift lever for common movement therewith and, when shift resistance to movement of said transmission from either the forward drive position or the reverse drive position to the neutral position is greater than a predetermined level, for movement relative to said shift lever and to the normal position, said shift assistance means also including a switch slideably carried by said shift lever for movement relative thereto between a normally deactuated position and an actuated position, and operable when actuated to selectively interrupt the ignition of said engine, said switch being located for operable engagement by said element so as to move said switch to the actuated position when a force applied on said element and the shift resistance exceeds said predetermined level, said shift assistance means further including biasing means for retaining said element in the normal position relative to said shift lever when said shift lever moves in response to a force applied on said element and the shift resistance is below said predetermined level and for permitting displacement of said element relative to said shift lever from the normal position when the shift resistance exceeds said predetermined level, a push-pull assembly pivotally connected to said element for applying a force thereto by an operator, said shift means also including cam means on said shift lever having a cam surface which is engaged by and guides movement of said element relative to said shift lever, which has a central portion, and which has diverging ramp portions extending from said central portion towards said switch, said element being disposed in said central portion of said cam surface when in the normal position and moving along one of said ramp portions of said cam surface when a pulling or pushing force is applied on said element by said push-pull assembly to move said shift lever and the shift resistance exceeds said predetermined level, and means for interrupting engine ignition in response to movement of said element from the normal position and relative to said shift lever.

7. A marine propulsion device according to claim 6 wherein said cam surface is a portion of an opening in said shift lever including another portion in which said switch is slidably mounted and wherein said bias means comprises a compression spring bearing against said switch to urge said element toward the central portion of said cam surface and to permit said element to move along one of said ramp portions of said cam surface to actuate said switch when a pulling or pushing force is applied on said element by said push-pull assembly and the shift resistance exceeds said predetermined level.

* * * * *